US006491179B2

(12) United States Patent
Dokun

(10) Patent No.: US 6,491,179 B2
(45) Date of Patent: Dec. 10, 2002

(54) FLOATING DRINK TRAY

(76) Inventor: Gabriel O. Dokun, 300 Hoffman Blvd. #1-H, New Brunswick, NJ (US) 08901

( * ) Notice: Subject to any disclaimer, the term of this patent is extended or adjusted under 35 U.S.C. 154(b) by 0 days.

(21) Appl. No.: 09/941,338

(22) Filed: Aug. 29, 2001

(65) Prior Publication Data

US 2002/0027141 A1 Mar. 7, 2002

Related U.S. Application Data

(60) Provisional application No. 60/230,238, filed on Sep. 1, 2000.

(51) Int. Cl.[7] ..... B65D 25/20

(52) U.S. Cl. ..... 220/560; 220/575; 220/737; 220/507

(58) Field of Search ..... 220/560, 575, 220/574, 556, 720, 737, 915.1, 4.01, 507, DIG. 10

(56) References Cited

U.S. PATENT DOCUMENTS

| | | | | | |
|---|---|---|---|---|---|
| 3,367,525 | A | * | 2/1968 | Elder | 220/556 |
| 4,070,735 | A | * | 1/1978 | Canaday | 160/349.2 |
| 4,927,041 | A | * | 5/1990 | Hepburn | 220/560 |
| 5,732,849 | A | * | 3/1998 | Brooks | 220/737 |
| 6,016,933 | A | * | 1/2000 | Daily et al. | 220/560 |

* cited by examiner

*Primary Examiner*—Stephen Castellano
(74) *Attorney, Agent, or Firm*—Thomas C. Saitta

(57) ABSTRACT

An anchored, floating drink tray having an annular floating member which maintains a main body above the surface of the water, the main body having a plural number of drinking glass recesses which receive lidded glasses in a secure manner, such that the tray may be temporarily inverted or submerged without harm to the contents in the glasses.

9 Claims, 3 Drawing Sheets

FLOATING DRINK TRAY

This application claims the benefit of U.S. Provisional Patent Application Ser. No. 60/230,238, filed Sep. 1, 2000.

BACKGROUND OF THE INVENTION

This invention relates generally to the field of trays used to support or retain drinking glasses, and more particularly to such devices adapted so as to float for use in a pool, where the tray is removable from the floating means for use out of the pool, and where the glasses are removably securable to the tray and provided with lids to protect from spillage should the floating tray be submerged or even inverted.

It is often desirable when enjoying the relaxation of a swimming pool or lake to have easy access to food and beverages. Such access is easily accomplished on land or shore, but not so easily accomplished when one is floating or swimming in the water.

It is an object of this invention to provide a floating drink tray which can be put into the water to provide an easily accessible support surface on which drinking glasses, beverage cans, food, ice, etc., can be placed. It is a further object to provide such a floating tray wherein the drinking glasses or cans are retained within recesses to preclude accidental spilling of the contents, with one or more additional recesses provided to retain ice or food products. It is a further object to provide such a floating tray where an anchor means is utilized to secure the tray in a fixed location. It is a further object to provide a floating tray where the glasses are provided with lids and are locked into recesses in the support surface such that the tray can be temporarily submerged or inverted without negative effect to the drinks.

SUMMARY OF THE INVENTION

The invention is a floating drink tray comprising a generally circular main body which is connected to an annular floating member, either permanently or most preferably removably, by connector means comprising straps, hooks, suction cups or similar members. The upper surface of the main body is provided with a plural number of drinking glass recesses which are adapted to retain in a secure manner removable drinking glasses having lids. Most preferably locking means are provided to secure the drinking glasses within the drinking glass recesses, such that the drinking glasses are restraining from tipping over until removed by the user. A centrally located recess is provided in the main body to receive ice, chips or other items. The annular floating member may be formed as an inflatable ring, a ring made of expanded polymer foam, or a ring of any floating material, and may be provided with a bottom. An anchor is provided and is tethered preferably to the underside center of the main body.

DETAILED DESCRIPTION OF THE INVENTION

Figure 1:
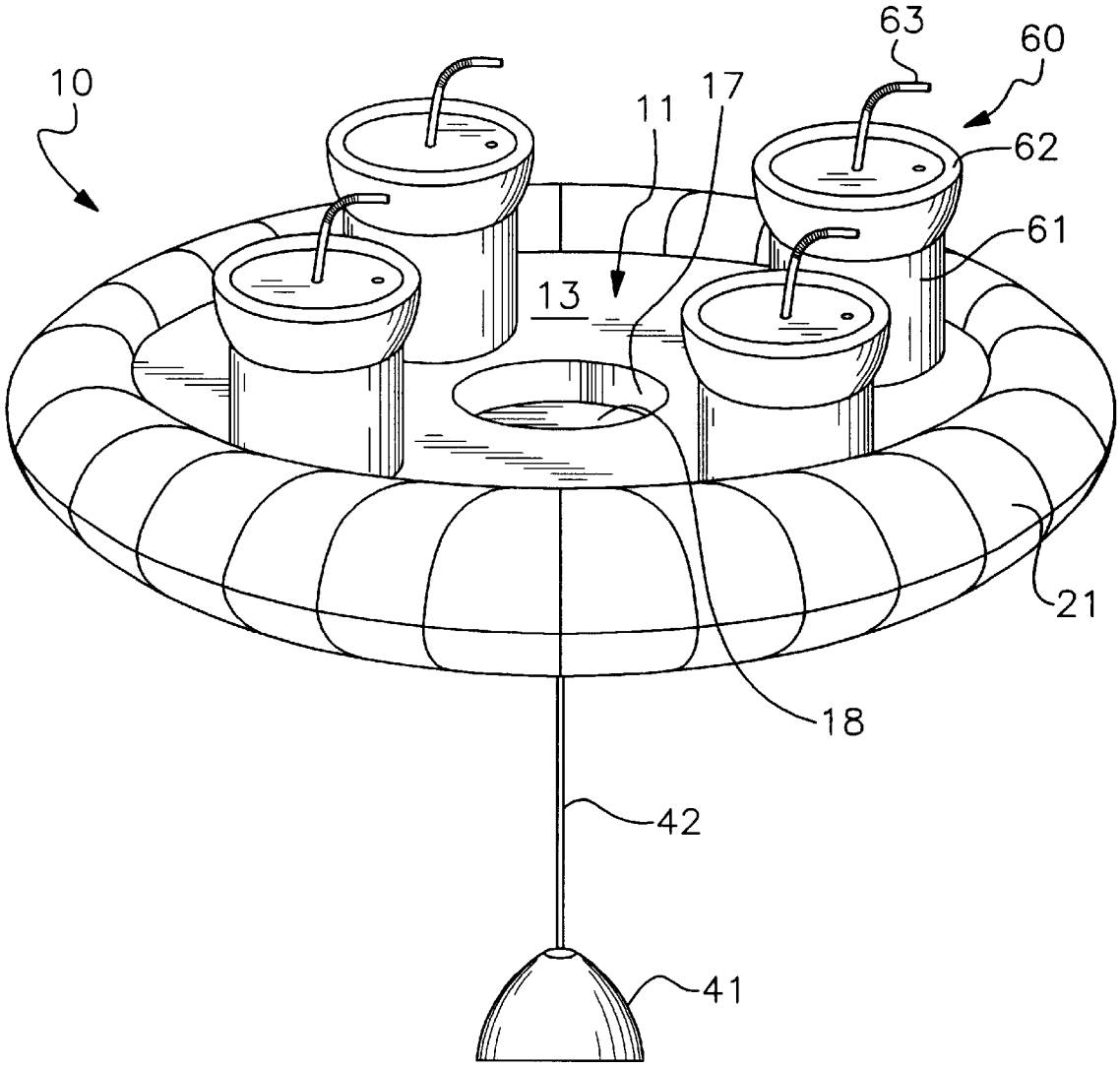
FIG. 1 is a perspective view of the invention, showing the drinking glasses as retained within the drinking glass recesses.
Figure 2:
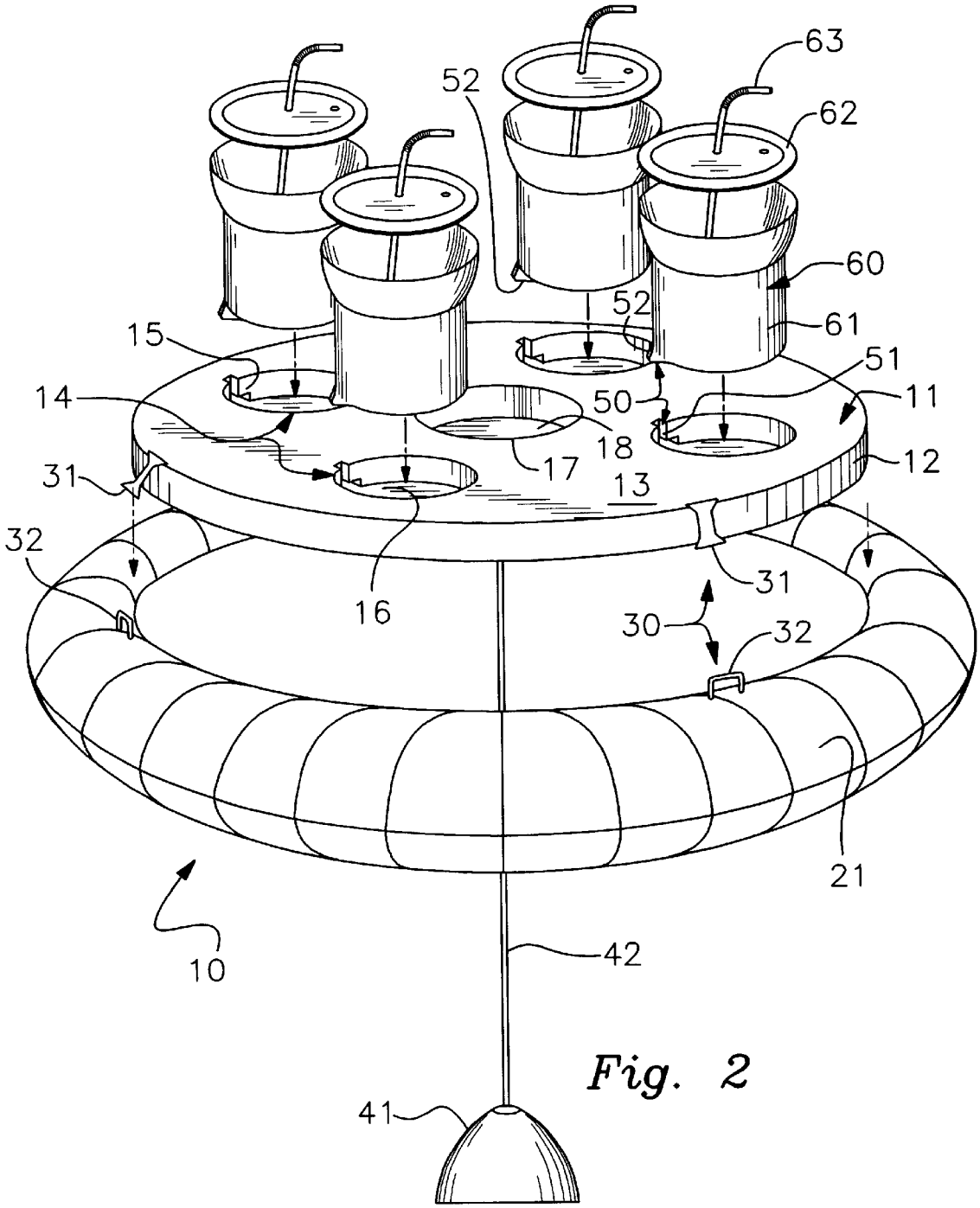
FIG. 2 is an exploded perspective view similar to FIG. 1.

With reference to the drawings, the invention will now be described in detail with regard for the best mode and the preferred embodiment. In general, the invention is a floating drink tray for supporting and removably retaining drinking glasses, cans, bottles, ice, food, etc. in a pool or on a pond or lake, where the tray member is most preferably removable from the floating member.

The floating tray device 10 comprises mainly a main body 11 and a floating member 21. The floating member 21 is preferably annular, although it would be possible to construct the floating member 21 in other shapes a well. Floating member 21 is comprised of a buoyant material or constructed in a manner such that it will float on the surface of water even when loaded with the main body 11, drinking glasses 60 and other items. In a preferred embodiment, the floating member 21 is formed of an inflatable annular tube having an air impermeable wall 24 and a valve 23 for introduction of air into its interior, with a float bottom 22 extending horizontally. Alternatively, floating member 21 may be composed of a material with inherent flotation properties, such as a relatively rigid expanded polymer foam or other plastic, wood, tubular aluminum, or like material.

Figure 3:
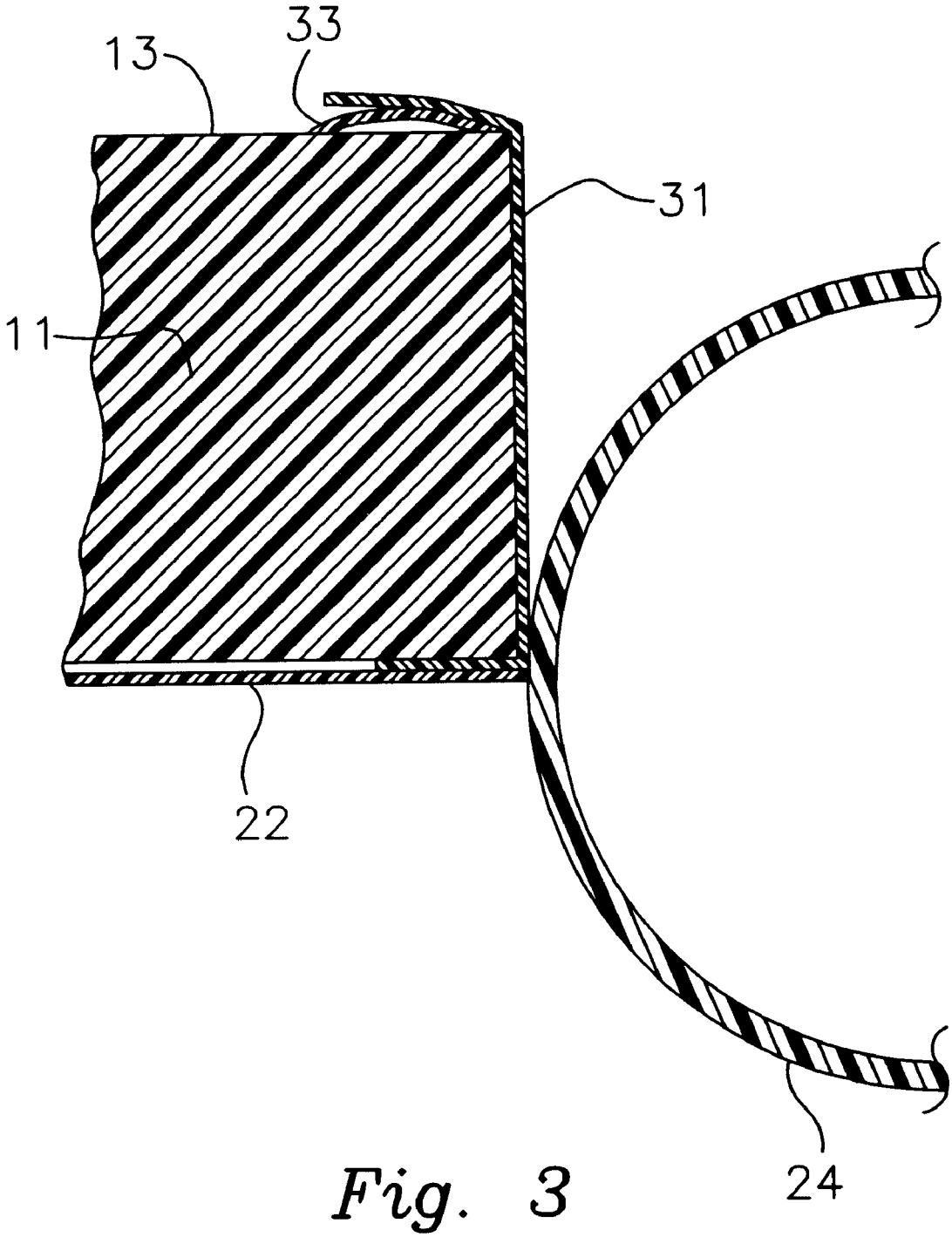
FIG. 3 is a partial cross-sectional view showing connecting means for securing the tray member to the floating member.

The support surface 11 is attached to the floating member 21, most preferably in removable manner by connector means 30, which in the drawings is shown to comprise plural strap members 31, preferably elastic, adapted to be connected to hook members 32, or as shown in FIG. 3, strap members 31 with suction cup members 33 which are adapted to be secured to the upper surface 13 of the tray main body 11. The main body 11 has an upper surface 13 of a generally planar nature and a perimeter 12, where the perimeter 12 generally corresponds to and fits within the interior of the floating member 21. The main body 11 is preferably composed of a plastic material, although other materials such as wood, metal or the like suitably sturdy and able to be placed into water may be utilized as well. The main body 11 is provided with a plural number of drinking glass recesses 14 which are adapted to receive drinking glasses 60 in a relatively secure manner such that the glasses 60 are not prone to tipping. Most commonly, the drinking glass recesses 14 will be circular as shown, each having an annular side wall 15 and relatively flat bottom 16, although it is contemplated that the recesses 14 could be bottomless if the glasses 60 were properly configured with a shoulder or increased upper diameter to prevent them from falling completely through the main body 11. Preferably, the main body 11 is also provided with a larger central recess 17 having a bottom 18, which may be used to retain ice, food, or other items. A lid may be provided to seal the central recess 17.

Most preferably, drinking glass locking means 50 are provided whereby the glasses 60 are securely retained within the drinking glass recesses 14 in a detachable manner, such that when the glasses 60 are inserted into the recesses 14 they are retained in an upright position, yet remain easily removable for use. In the embodiment shown, the drinking glass locking means comprises an L-shaped slot 51 positioned in the side wall 15 of each recess 14. A corresponding tab member 52 is located on the lower portion of the body 61 of glasses 60. The glasses 60 are locked into the recesses 14 by aligning the tab 52 with the vertical portion of the slot 51, inserting the glass 60 into the recess 14, then rotating the glass 60 such that the tab 52 is positioned within the horizontal portion of the slot 51. To remove the glass 60, the procedure is reversed. Other types of mechanical interlocks may be substituted for that shown, and other means to secure the glasses 60 in the recesses 14, such as a friction fit, the use of a resilient member, etc. may be utilized. It is most preferred that the glasses 60 comprise a body 61, a removable lid member 62 and a straw 63, as this construction best precludes spilling the drinks into the pool or accidentally getting water in the beverages should the tray 10 be tipped, inverted or submerged.

The floating tray 10 is preferably provided with an anchor member 41, attached to the float bottom 22 or to the underside of the main body 11 at the central recess 17 by an anchor connection means 42, such as a string, line or cable. The anchor member 41 is preferably composed of a high density rubber, plastic or similar material suitable for extended immersion in water. In this manner the floating tray 10 may be precluded from drifting due to wind, wave action, current, etc.

By providing glasses 60 with lids 62, and further by providing locking means 50 to secure the glasses 60 into the recesses 14, the floating tray 10 can be submerged or temporarily inverted without negative effect to the beverages within the glasses 60.

It is contemplated that substitutions and equivalents for certain elements set forth above may be obvious to those skilled in the art, and therefore the true scope and definition of the invention is to be as set forth in the following claims.

I claim:

1. A floating drink tray comprising:

a main body having a plurality of drinking glass recesses each adapted to receive a drinking glass, said drinking glass recesses each having locking means to releasably retain said drinking glasses in a secure manner;

a floating member releasably joined to said main body by connector means comprising a plurality of strap members and suction cup members, said floating member adapted to support said main body above a water surface.

2. The tray of claim 1, wherein said floating member is annular and said main body is circular.

3. The tray of claim 1, wherein said locking means to releasably retain said drinking glasses comprises a tab member disposed on each said drinking glass and an L-shaped slot positioned in each of said drinking glass recesses adapted to receive said tab member.

4. The tray of claim 1, further comprising anchor means and anchor attachment means connecting said anchor means to said main body.

5. The tray of claim 1, further comprising anchor means and anchor attachment means connecting said anchor means to said floating member.

6. The tray of claim 1, wherein said floating member further comprises a bottom.

7. The tray of claim 1, wherein said floating member is inflated.

8. The tray of claim 1, further comprising a central recess disposed in said main body.

9. A floating drink tray comprising:

a circular main body having a central recess and a plurality of drinking glass recesses each adapted to receive a drinking glass, said drinking glass recesses each having locking means to releasably retain said drinking glasses in a secure manner, wherein said locking means to retain said drinking glasses comprises a tab member disposed on each said drinking glass and an L-shaped slot positioned in each of said drinking glass recesses adapted to receive said tab member;

an inflated annular floating member releasably joined to said main body by connector means, said floating member adapted to support said main body above a water surface, wherein said connector means joining said floating member to said main body comprises strap members and suction cups;

an anchor means and anchor attachment means joining said anchor means to said floating member.

* * * * *